US010624461B2

(12) United States Patent
Sloop

(10) Patent No.: US 10,624,461 B2
(45) Date of Patent: Apr. 21, 2020

(54) BABY ON BOARD INFANT FLOAT

(71) Applicant: Stephanie Fritsch Sloop, Indian Land, SC (US)

(72) Inventor: Stephanie Fritsch Sloop, Indian Land, SC (US)

( * ) Notice: Subject to any disclaimer, the term of this patent is extended or adjusted under 35 U.S.C. 154(b) by 0 days.

(21) Appl. No.: 16/270,912

(22) Filed: Feb. 8, 2019

(65) Prior Publication Data

US 2019/0246801 A1 Aug. 15, 2019

Related U.S. Application Data

(60) Provisional application No. 62/628,488, filed on Feb. 9, 2018.

(51) Int. Cl.

| | |
|---|---|
| ***B63C 9/08*** | (2006.01) |
| ***A47C 15/00*** | (2006.01) |
| ***B63B 34/50*** | (2020.01) |

(52) U.S. Cl.

CPC ..... *A47C 15/006* (2013.01); *B63B 34/50* (2020.02); *B63C 9/08* (2013.01)

(58) Field of Classification Search

CPC ..... A47C 15/006; B63B 35/74; B63C 9/08

See application file for complete search history.

(56) References Cited

U.S. PATENT DOCUMENTS

| | | | | |
|---|---|---|---|---|
| 4,799,910 | A * | 1/1989 | Kellough | A47C 15/006 441/130 |
| 4,929,207 | A * | 5/1990 | Piatt | B63B 35/7906 114/123 |
| 6,168,486 | B1 * | 1/2001 | Lin | B63B 35/7906 441/129 |
| 6,318,287 | B1 * | 11/2001 | Klimenko | B63B 7/085 114/345 |
| 2006/0108843 | A1 * | 5/2006 | Suprina | A47C 1/12 297/217.7 |

* cited by examiner

*Primary Examiner* — Stephen P Avila
(74) *Attorney, Agent, or Firm* — Melissa B. Neely

(57) ABSTRACT

The invention disclosed in this application is a floatation device for infants and small children combined with an exercise device for their parent. The device is designed to allow the child to be in the swimming pool with their parent with only a small part or none of the child to actually be in contact with the water. The invention consists of a seat for the child integrated into a floatation device. The child's seat will swivel to allow for the child to be facing in various directions while on the floatation device. Sections of the seat are removable so that the child may dangle their legs into the water while affixed in the seat. The floatation part of the invention is similar in size and shape to an adult swimming kickboard and can be utilized as such with a child either in the seat or not.

4 Claims, 6 Drawing Sheets

BABY ON BOARD INFANT FLOAT

CROSS REFERENCE TO RELATED APPLICATIONS

Provisional Patent Application No. 62/628,428
Filing Date: Feb. 9, 2018
Relationship: Provisional application was for same invention.

STATEMENT REGARDING FEDERALLY SPONSORED RESEARCH OR DEVELOPMENT

This invention was not made by an agency of the United States Government nor under a contract with an agency of the United States Government.

THE NAME OF THE PARTIES TO JOINT RESEARCH AGREEMENT

Not Applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Provisional Patent Application No. 62/628,488
Filing Date: Feb. 9, 2018
Relationship: Provisional application was for same invention.

BACKGROUND OF THE INVENTION

Field of the Invention

Playing or swimming in a pool is a warm weather activity enjoyed by many; adults and children both enjoy aquatic activities. Summer time is often family pool time. However, for the very young the initial forays into a swimming pool can be a frightening and dangerous activity.

Floats especially design for infants or young children are often used by parents to reduce the risk for their children when playing in a pool. Typical floats are inflatable donut shaped devices with the infant suspended in the center hole with their lower body in the water and the upper body out of the water. There is often a harness or other type of seat suspended below the floating donut to hold the child in place. Some of the floats provide canopies for protection from the sun.

Some inflatable donut style floats are designed to fit around the infant's neck and keep the head out of water while the rest of the infant's body is submerged.

However, some infants are fearful of the water and are afraid to have any part of their body submerged. The present invention is a device that allows a parent to take their infant into the pool with them without the infant being in the water. As the infant grows less fearful of the water, the disclosed device can be easily modified to allow the infants legs to enter the water while keeping them secure on the float. After growing more use to being partially in the water, the infant can graduate to a float that allows for more of the body to be submersed.

The invention disclosed in this application can also be used as an aquatic exercise device, most commonly referred to a kickboard. The parent can place their child in the seat portion of the invention and then exercise with the device functioning as a kickboard all the while keeping the child in their immediate presence.

Description of Related Art

The Combination Child Float/Adult Aquatic Exercise Device (U.S. Pat. No. 5,766,052 issued Jun. 16, 1998 to Martha C. Metro and Naomi R. Fine) describes a device that is a combination kickboard for an adult and a floatation device for a child. This invention submerges the lower portion of the child in the water allowing for the torso to be above water. Unlike the present invention, there is no provision for the child to remain out of the water when using the device.

BRIEF SUMMARY OF THE INVENTION

The invention disclosed in this application is a floatation device for infants and small children and exercise device for their parent. The device is designed to allow the child to be in the swimming pool with their parent with only a small part or none of the child to actually be in contact with the water. The invention consists of a seat for the child integrated into a floatation device. The child's seat will swivel to allow for the child to be facing in various directions while on the floatation device. Sections of the seat are removable so that the child may dangle their legs into the water while affixed in the seat. The floatation part of the invention is similar in size and shape to an adult swimming kickboard and can be utilized as such with a child either in the seat or not.

DETAILED DESCRIPTION OF THE INVENTION

The invention disclosed in this application is a floatation device for infants and small children enjoy aquatic activities with their parents. The device consists of a buoyant planar base (10) with an integrated seat (20) at one end for a child. The buoyant planar base (10) is similar in size and shape to an adult kickboard and can be used for this purpose with or without a child in the integrated seat (20).

Figure 1:
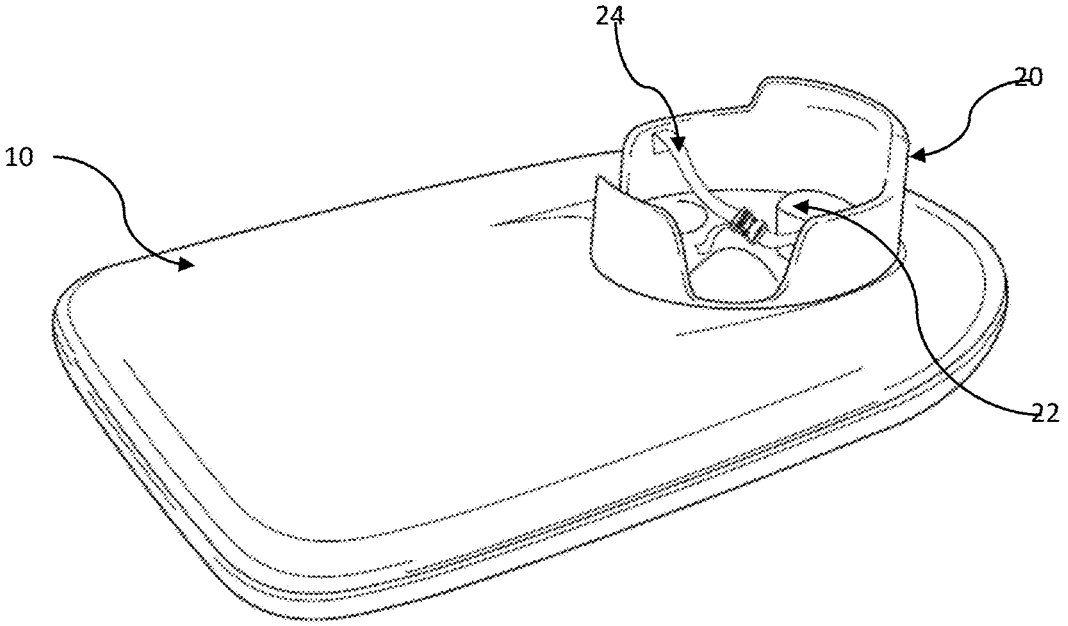
FIG. 1 depicts the invention showing the buoyant planar base (10), child's seat (20), removable inserts (22) and safety strap (24) for child's seat (20).
Figure 2:
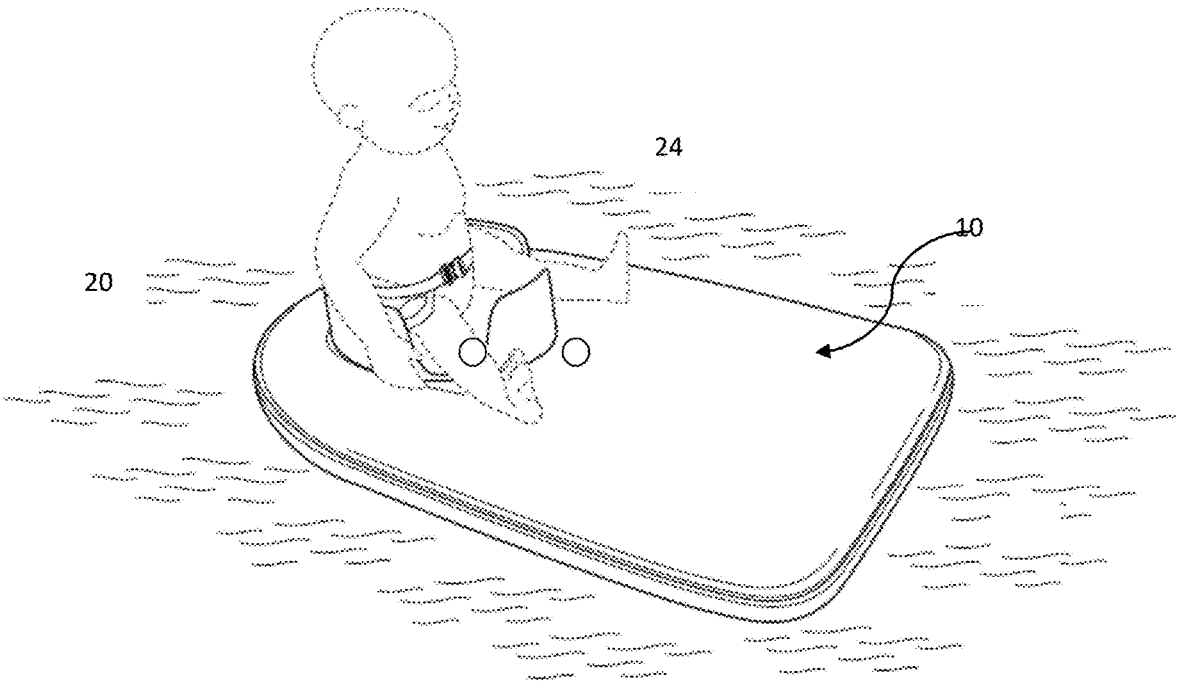
FIG. 2 depicts the invention being utilized for an infant showing the buoyant planar base (10), child's seat (20) with an infant in the seat (20) with the attached safety strap (24).
Figure 3:
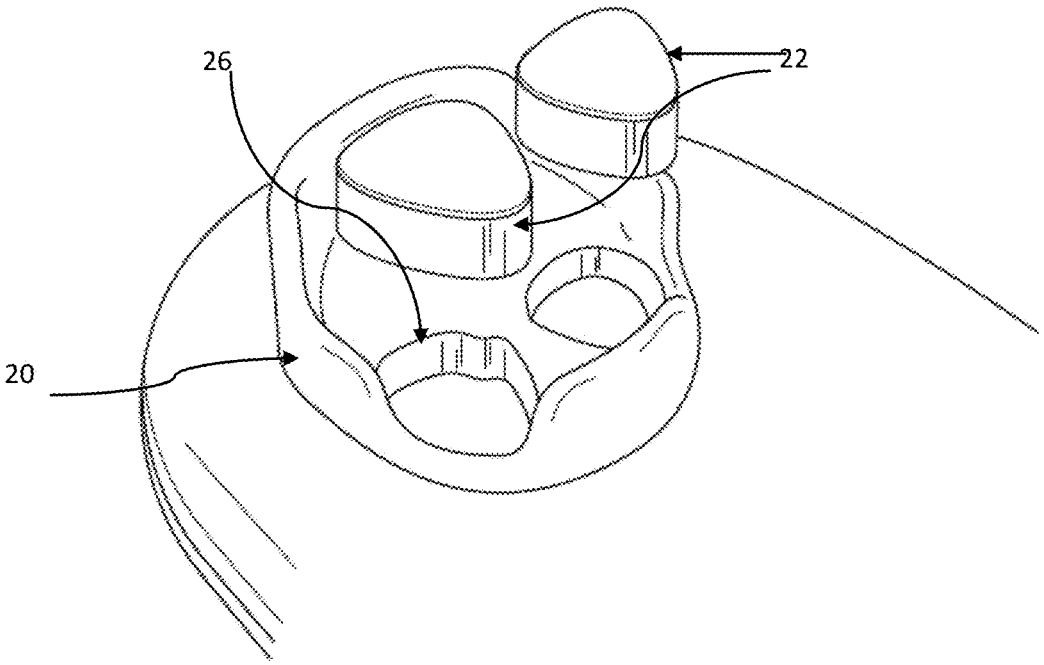
FIG. 3 is a drawing of the child's seat (20) with the inserts (22) removed to allow the child in the seat to put their legs through the leg apertures (26) into the water.
Figure 4:
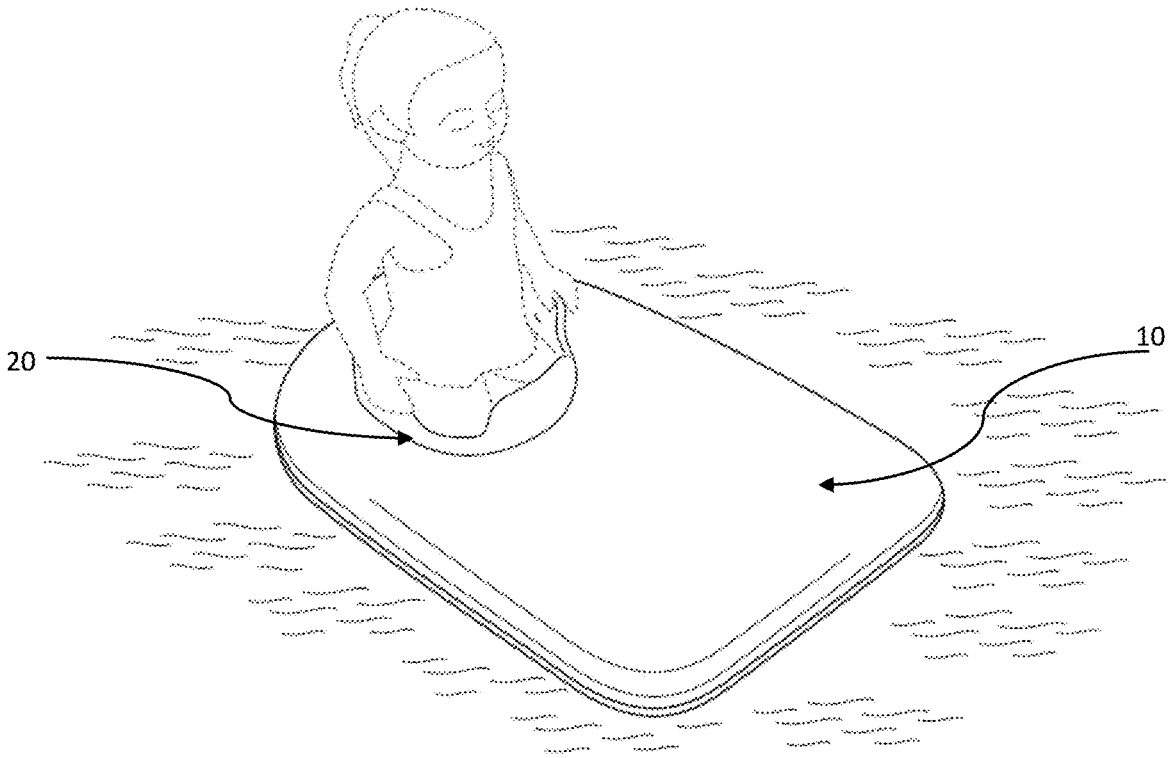
FIG. 4 depicts the invention in use for a child with the inserts (22) removed with the child in the seat (20) having their legs in the water.
Figure 5:
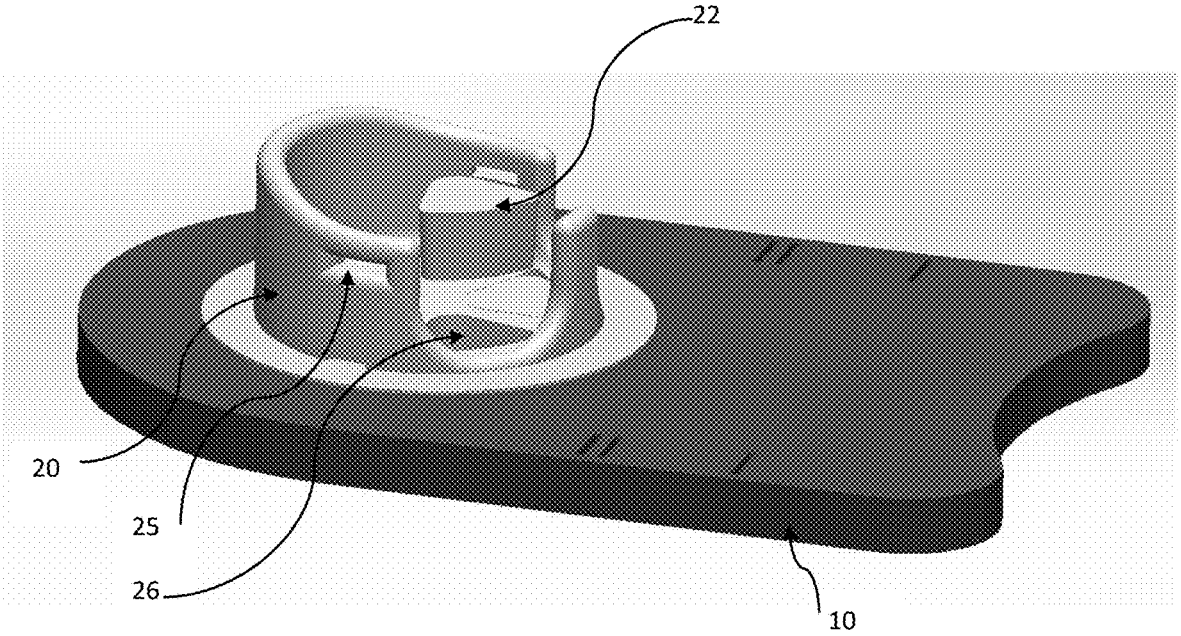
FIG. 5 depicts the invention showing the buoyant planar base (10), child's seat (20), inserts (22), slot (25) for safety strap and aperture (26) for child's legs to enter water.
Figure 6:
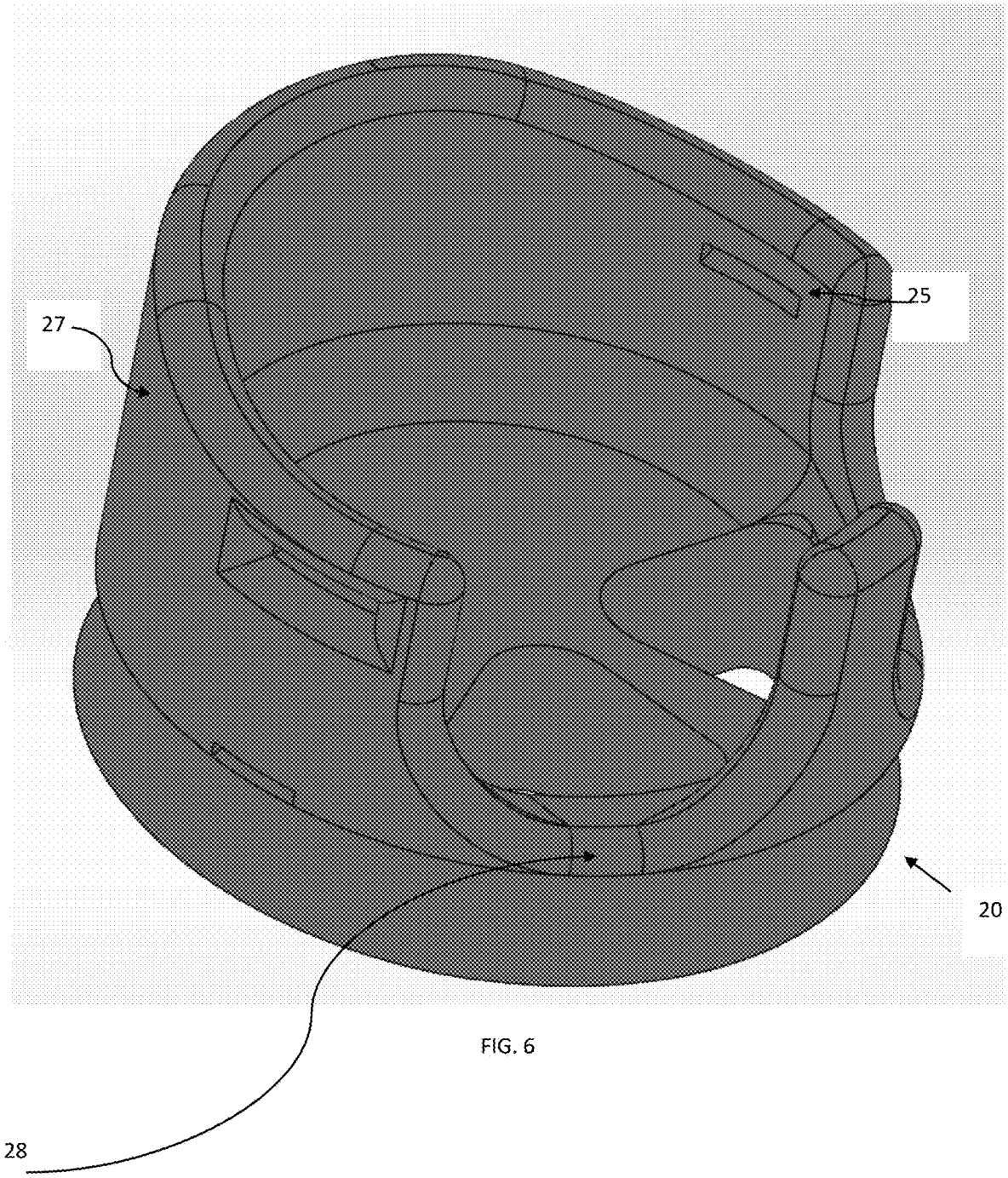
FIG. 6 is a view of the child's seat (20) showing the slots (25) for the safety strap, the sidewalls (27) of the seat and the recessed area (28) for the infant to place their legs.

The integrated child's seat (20) is configured to receive a child therein and can be rotated so that the child faces a desired direction. The seat (20) includes a circumferential sidewall (27) have recessed areas (28) for receiving the child's legs therethrough, such that the child's legs may rest on the upper surface of the buoyant planar base (10) as shown in FIG. 2.

The integrated child's seat (20) is further equipped with a pair of inserts (22) that are removably disposed within a pair of leg apertures (26) in a frictional engagement therewith. When the inserts (22) are installed, the child's legs rest on the upper surface of the buoyant planar base (10). When the inserts (22) are removed, the child's legs extend through the leg apertures (26) and rest in the water, allowing the child to experience the sensation of water on their skin.

The integrated child's seat (20) is further equipped with apertures (25) on opposite sides of the circumferential sidewall (27) for the inclusion of a safety belt to more securely hold the child in the integrated seat (20).

In the preferred embodiment of the invention, the buoyant planar base (10) of the invention is constructed of a closed cell polyethylene foam. The child's seat (20) and its various parts are constructed of a UV resistant thermoplastic. However, construction of the invention is not limited to these materials.

In some embodiments of the invention, it is envisioned that the buoyant planar base (10) will be configured with handles carrying the invention and ease of use of the invention as a kickboard by the parent either with or without a child in the integrated seat (20).

The potential patent classification for this invention:

Class 441: Buoys, Rafts, and Aquatic Devices

Subclass 130: Body Supporting Buoyant Device with Seat

The present invention described above and illustrated in FIGS. 1 through 6 is visualized as the preferred embodiment of the invention. It is envisioned that this invention may be embodied in many different forms and should not be construed as limited to the embodiments set forth herein. It will be understood by those skilled in the art that changes in forms and details may be made without departing from the spirit and scope of the present application. It is therefore intended that the present invention not be limited to the exact forms and details described and illustrated herein but falls within the scope of the appended claims.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a stricture or feature that is disposed "adjacent" another feature may have portions that overlap or underlie the adjacent feature.

The invention claimed is:

1. An exercise device for adults consisting of a buoyant planar base constructed of closed cell polyethylene foam with a seat for an infant or small child at one end of the buoyant planar base where said seat includes a circumferential sidewall having recessed areas for receiving the child's legs therethrough, that the child's legs may rest on the upper surface of the buoyant planar base, where said seat is further equipped with inserts that are removably disposed within a pair of leg apertures in said seat, that the child's legs may extend through the leg apertures into the water when said inserts are removed.

2. The device of claim 1, where said seat for infant or small child is constructed of UV resistant thermoplastic.

3. A floatation device for small children consisting of a buoyant planar base constructed of closed cell polyethylene foam with a seat for an infant or small child at one end of the buoyant planar base where said seat includes a circumferential sidewall having recessed areas for receiving the child's legs therethrough, that the child's legs may rest on the upper surface of the buoyant planar base, where said seat is further equipped with inserts that are removably disposed within a pair of leg apertures in said seat, that the child's legs may extend through the leg apertures into the water when said inserts are removed and where said floatation device can be utilized as an exercise kickboard for an adult with the child in said seat.

4. The device of claim 3, where said seat for infant or small child is constructed of UV resistant thermoplastic.

* * * * *